US009124985B2

(12) United States Patent
Kwon

(10) Patent No.: US 9,124,985 B2
(45) Date of Patent: Sep. 1, 2015

(54) HEARING AID AND METHOD FOR AUTOMATICALLY CONTROLLING DIRECTIVITY

(71) Applicant: Algor Korea Co., Ltd., Gwangju (KR)

(72) Inventor: You Jung Kwon, Gwangju (KR)

(73) Assignee: ALGOR KOREA CO., LTD., Gwangju (KR)

( * ) Notice: Subject to any disclaimer, the term of this patent is extended or adjusted under 35 U.S.C. 154(b) by 0 days.

(21) Appl. No.: 14/024,345

(22) Filed: Sep. 11, 2013

(65) Prior Publication Data

US 2014/0079259 A1 Mar. 20, 2014

(30) Foreign Application Priority Data

Sep. 17, 2012 (KR) ..... 10-2012-0102761

(51) Int. Cl.
*H04R 25/00* (2006.01)
*H04R 3/00* (2006.01)

(52) U.S. Cl.
CPC ..... *H04R 25/407* (2013.01); *H04R 25/405* (2013.01); *H04R 2201/403* (2013.01); *H04R 2430/23* (2013.01)

(58) Field of Classification Search
CPC ..... H04R 2201/403; H04R 2430/23; H04R 25/405; H04R 25/407
USPC ..... 381/92, 94.9, 312, 313
See application file for complete search history.

(56) References Cited

U.S. PATENT DOCUMENTS

2004/0136541 A1* 7/2004 Hamacher et al. ..... 381/60
2005/0232452 A1* 10/2005 Armstrong et al. ..... 381/317

FOREIGN PATENT DOCUMENTS

KR 10-2009-0045453 5/2009

* cited by examiner

*Primary Examiner* — Davetta W Goins
*Assistant Examiner* — Phylesha Dabney
(74) *Attorney, Agent, or Firm* — Kile Park Reed & Houtteman PLLC

(57) ABSTRACT

A hearing aid for automatically controlling directivity is provided. The automatic directivity controlling hearing aid controls an amplification factor and delay time for each of a plurality of acoustic signals that are generated from a plurality of microphones, to thus automatically enhance directivity so that a speech sound can be strongly heard among ambient sounds that are generated in the vicinity. Therefore, even any directional voices may be heard as accurate voices by enlarging intensity of a speech sound in contrast to ambient noise.

7 Claims, 4 Drawing Sheets

HEARING AID AND METHOD FOR AUTOMATICALLY CONTROLLING DIRECTIVITY

TECHNICAL FIELD

The present invention relates to a hearing aid, and more particularly to a hearing aid that automatically controls directivity of a sound, to thus improve audibility of the sound.

BACKGROUND ART

Hearing aids receive and amplify sounds and provide the amplified sounds to hard-of-hearing persons. In general, the hearing aids are classified according to amplification methods, circuit characteristics, and shapes.

According to amplification methods, the hearing aids are classified into a linear amplification type by which sounds are linearly amplified and a non-linear amplification type by which sounds are non-linearly amplified. According to circuit characteristics, the hearing aids are classified into an analog type implemented by analog circuits, and a digital type implemented by digital circuits. However, the typical hearing aids are classified according to shapes of the hearing aids.

According to shapes of the hearing aids, the hearing aids are classified into pocket type or box type hearing aids, BTE (Behind-The-Ear) type hearing aids, ITE (In-The-Ear) type hearing aids, ITC (In-The-Canal) type hearing aids, CIC (Completely-In-the-Canal) type hearing aids, and eyeglass type hearing aids.

The hearing aids are developed in various ways according to convenience of users or depending on the intended use. Hearing aids are currently under development in various types.

In order to increase performance and functionality of hearing aids, various us additional devices are recently added to the hearing aids. As well, the number of components such as microphones is changed in various ways. One of techniques to increase performance of hearing aids is a technology of strengthening directivity for a specific direction, to thereby make sound sources that are generated in a particular direction better heard than those occurring in another direction.

FIG. 1 is a block diagram showing a conventional hearing aid to obtain a directional pattern.

FIG. 1 shows a hearing aid that is disclosed in Korean Patent Laid-open Publication No. 2009-0045453 published on May 8, 2009, and that includes two microphones M1 and M2, a time delay ID, an adder ADD, and a signal processor PCS. The two microphones M1 and M2 receive ambient sounds, respectively, to then generate a sound signal. The time delay D delays the sound signal generated the microphone M2 by a predetermined time and outputs the time-delayed sound signal. The adder ADD adds the sound signal output from the microphone M1 and the output signal of the time delay D, and outputs the added result. The signal processor PCS performs signal processing such as amplification or noise cancellation with the output signal of the adder ADD, to then output the sound via a speaker (not shown). Accordingly, the pattern of the directivity of the hearing aid is kept constant. For example, sounds occurring in front of users can be heard well than sounds occurring in the other directions.

However, the conventional hearing aid shown in FIG. 1 has a drawback that a direction orienting sound sources is fixed to a particular direction, to thus cause inconveniences of controlling delay time in each case in order to change the direction of orientation of the hearing aid.

DISCLOSURE

Technical Problem

To solve the above problems, it is an object of the present invention to provide a hearing aid that automatically enhances directivity of a plurality of sounds that are generated from a plurality of microphones and then input to the hearing aid, in a direction where a speech sound occurs, to thus increasing intensity of the speech sound in contrast to ambient noise so that the speech sound can be accurately heard.

Technical Solution

To accomplish the above object of the present invention, there is provided a hearing aid for automatically controlling directivity, the hearing aid comprising:

a first input unit that senses a sound to thus generate a first audio signal, and amplifies the first audio signal in response to a first amplification control signal, to then output a first input signal;

at least one second input unit that senses the sound to thus generate a second audio signal, and amplifies and delays the second audio signal in response to at least one second amplification control signal and at least one delay time control signal, to then output a second input signal;

a subtraction unit having at least one subtractor that is configured in a multi-stage of the same number as that of the at least one second input unit, and that subtracts the second input signal output from a corresponding second input unit among the at least one second input unit from a cumulative subtraction signal output from a preceding stage, to thus output the cumulative subtraction signal;

a directivity controller that receives the cumulative subtraction signal output from a last stage subtractor among the at least one subtractor, performs a filtering of the received signal to thus extract a speech sound signal, compares the maximum value of the extracted speech sound signal with a predetermined threshold value, and controls the first amplification control signal, the at least one second amplification control signal, and the at least one delay time control signal, to thus output the controlled result; and an output unit that receives and amplifies the cumulative subtraction signal output from the last stage subtractor among the at least one subtractor.

Preferably but necessarily, the directivity controller comprises:

a filter unit that receives and filters the cumulative subtraction signal, to thereby extracting the speech signal;

a maximum value detector for detecting the level of the speech signal and detecting the maximum value;

a threshold value setting unit that set and stores the threshold;

a comparator that compares the maximum value with the threshold value, and outputs a comparison value if the maximum value is less than the threshold value;

an amplification factor controller that controls the first amplification control signal and the at least one second amplification control signal, respectively, in response to the comparison value, and outputs the controller result; and a delay time controller that controls the at least one delay time control signal, respectively, in response to the comparison value, and outputs the controller result.

Preferably but not necessarily, the filter unit comprises:

a band-pass filter that receives the cumulative signal and performs band pass filtering; and a rectifier filter that rectifies the output signal band-pass filter, and outputs the speech sound signal.

Preferably but not necessarily, the band-pass filter extracts a band signal of 100 Hz to 4 KHz with a center frequency of 1 KHz.

Preferably but not necessarily, the subtraction unit is configured so that the first stage subtractor among the at least subtractor subtracts the corresponding second input signal among the at least one second input signal from the first input signal, to thereby output the cumulative subtraction signal, and the last stage subtractor subtracts the corresponding second input signal among the at least one second input signal from the cumulative subtraction signal output from the preceding stage subtractor, to thereby output the cumulative subtraction signal.

Preferably but no necessarily, the first input unit comprises:

a first microphone that senses the sound and thus generates the first sound signal that is an analog signal;

a first analog-to-digital (A/D) converter that converts the first sound signal into a digital signal; and a first amplifier that amplifies the output signal of the first analog-to-digital (A/D) converter and outputs the amplification result, in response to the first amplification control signal output from the directivity controller.

Preferably but not necessarily, the at least one second input unit comprises:

a second microphone that senses the sound and thus generates the second sound signal that is an analog signal;

a second analog-to-digital (A/D) converter that converts the second sound signal into a digital signal;

a second amplifier that amplifies the output signal of the second analog-to-digital (A/D) converter and outputs the amplification result, in response to the second amplification control signal among the at least one amplification control signal output from the directivity controller; and a second time delay that delays the output al of e second amplifier and outputs the delay result, in response to the delay time control signal among the at least one delay time signal output from the directivity controller.

Preferably but not necessarily, the output unit comprises:

an output amplifier that receives the cumulative subtraction signal output from subtractor, and amplifies the received signal to then output the amplified result;

a digital-to-analog (D/A) converter that converts the output signal of the output amplifier into an analog signal; and a receiver having a speaker, and that receives the output signal of the D/A converter and outputs the received signal as the sound.

Preferably but necessarily, the hearing aid further comprises:

a first buffer that receives and buffers the cumulative subtraction signal output from the subtraction unit, to then output the buffered result to the output amplifier; and a second buffer that receives and buffers the signal output from the output amplifier, to then output the buffered result to the digital-to-analog (D/A) converter.

Advantageous Effects

As described above, the present invention provides a hearing aid for automatically controlling directivity, and controls an amplification factor and delay time for each of a plurality of acoustic signals that are generated from a plurality of microphones, to thus automatically enhance directivity so that a speech sound can be strongly heard among ambient sounds that are generated in the vicinity. Therefore, even any directional voices may be heard as accurate voices by enlarging intensity of a speech sound in contrast to ambient noise.

DESCRIPTION OF DRAWINGS

The above and other objects and advantages of the present invention will become more apparent by describing the preferred embodiment thereof in detail with reference to the accompanying drawings in which.

BEST MODE

Figure 1:
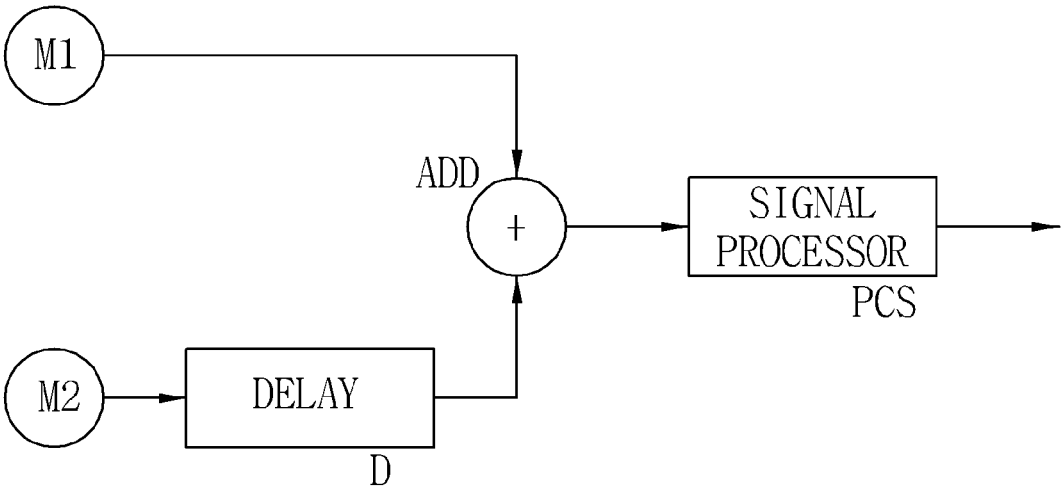
FIG. 1 (PRIOR ART)
FIG. 1 is a block diagram illustrating a conventional hearing aid to obtain a directional pattern.

In order to fully understand structure of the present invention, and advantages of operation of the present invention, and objectives achieved by embodiments of the present invention, the accompanying drawings illustrating preferred embodiments of the present invention should be referred to.

Hereinbelow, a hearing aid for automatically controlling directivity according to the present invention will be described with reference to the accompanying drawings. However, the present invention may be implemented in various modifications or variations, but is not limited thereto. In addition, portions that are not involved directly with the present invention are omitted to make the present invention clearer. Like reference numerals indicate like elements throughout the description of the figures.

Throughout the entire description, it will be further understood that the terms "comprises" and/or "comprising," when used in this specification, specify the presence of stated elements and/or components, but do not preclude the presence or addition of one or more other elements and/or components, unless otherwise defined. In addition, terms such as " . . . portion", " . . . unit", "module", and "block" indicate a unit that processes at least one function or operation, which may be implemented in hardware or software, or a combination of hardware and software.

Figure 2:
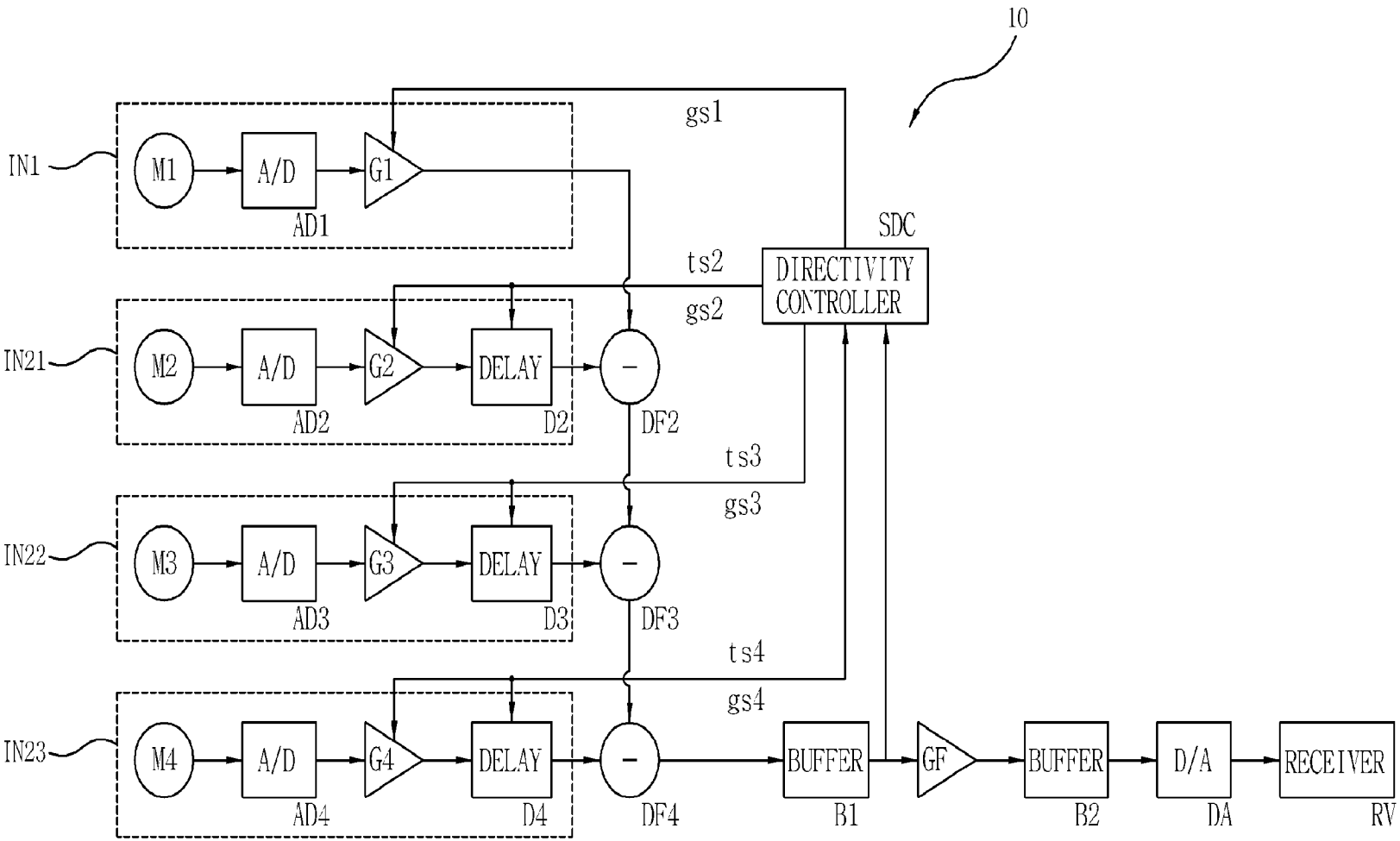
FIG. 2 is a circuit diagram showing a hearing aid for automatically controlling directivity according to an embodiment of the present invention.

FIG. 2 is a circuit diagram showing a hearing aid 10 for automatically controlling directivity according to an embodiment of the present invention.

Referring to FIG. 2, the automatic directivity controlling hearing aid 10 according to the present invention, includes: a plurality of, that is, four microphones M1 to M4, a plurality of, that is, four analog-to-digital (A/D) converters AD1 to AD4, a plurality of, that is, four input amplifiers G1 to G4, at least one time delay D2, D3, or D4, at least one subtractor DF2, DF3, or DF4, first and second buffers B1 and B2, an output amplifier GF, a digital-to-analog (D/A) converter DA, and a receiver RV.

Referring to FIG. 2, the four microphones M1 to M4 are distributively placed on the outside of the hearing aid 10, so as to receive a sound in a respectively different location. The locations where the four microphones M1 to M4 are arranged may be adjusted in various forms depending on the type of the hearing aid. The number of the microphones may be set in various form depending on the type or kind of the hearing aids, but should be at least two so as to detect and control the direction of the directivity of the hearing aid. In addition, the number of the microphones should be preferably at least four in order to increase the accuracy of the direction of the directivity of the hearing aid. When the four microphones M1 to M4 are distributively placed, respectively, even a sound that has been generated from an identical sound source is detected at different times at the respective microphones M1 to M4 depending on the position of each microphone. The automatic directivity controlling hearing aid controls the sounds detected by the respective microphones to be maximized, to thereby automatically control the direction of the directivity of the hearing aid.

The four microphones M1 to M4 detect the sounds, convert the sound signals into the analog electric signals, respectively, to thus output the analog electric signals. The four A/D converters AD1 to AD4 correspond to the four microphones M1 to M4, respectively, and receive the sound signals from the corresponding microphones among the four microphones M1 to M4, respectively, and convert the sound signals into digital signals to thus output the digital signals, respectively.

The four input amplifiers G1 to G4 correspond to the four A/D converters AD1 to AD4, respectively, and receive the sound signals from the corresponding A/D converters among the four A/D converters AD1 to AD4, respectively, and amplify the digital signals to thus output the amplified results, respectively. In this case, the four input amplifiers G1 to G4 receive the corresponding gain control signals among four gain control signals gs1 to gs4 output from a directivity controller (SDC), respectively, and control amplification factors of amplification signals in response to the received gain control signals gs1 to gs4, respectively. That is, the four input amplifiers G1 to G4 can amplify the digital signals at respectively different amplification factors, according to the received gain control signals gs1 to gs4, respectively.

The three time delays D2 to D4 correspond to the remaining input amplifiers G2 to G4, respectively, except for one input amplifier G1, among the three time delays D2 to D4. The three time delays D2 to D4 receive the amplification signals from the corresponding input amplifier G2 to G4 among the four input amplifiers G1 to G4, respectively, and delay the received amplification signals according to the corresponding delay time control signals among the three delay time control signals ts2 to ts4, respectively, to then output the delay signals, respectively.

Here, the reason why the number of the time delays D2 to D4 corresponds to that of the remaining input amplifiers G2 to G4 except for the input amplifier G1, is because there is no need to delay one amplification signal among a plurality of amplification signals. However, in the case that all the amplification signals output from the four input amplifiers G1 to G4 should be delayed (for example, in the case of synchronization of the signals considering the self-delay times of the time delays D2 and D3), or in the case of heightening ease of manufacturing or producing of hearing aids. In this case, the time delay (not shown) corresponding to the input amplifier G1 may be set to be a minimum value (for example, zero (0)) that may be set in a time delay as a delay time with respect to an amplification signal. In the case that a delay time is set as a minimum value in a time delay (not shown), the time delay (not shown) delays an amplification signal only by a self-delay time due to an internal circuit configuration, and outputs the delay signal. Therefore, in addition to the time of delaying the amplification signals in the other time delays D2 to D4 in response to the delay time control signals ts2 to ts4, the delay times of the time delays D2 to D4 are made to be identical to each other, to thus synchronize the signals.

The subtractor DF2 among the three subtractors DF2 to DF4 subtracts the delay signal from the time delay D2 from the amplification signal output from the input amplifier G1, to thus output a first subtraction signal. In addition, the subtractor DF3 subtracts the delay signal from the time delay D3 from the first subtraction signal output from the subtractor DF2, to thus output a second subtraction signal. In addition, the subtractor DF4 subtracts the delay signal from the time delay D4 from the second subtraction signal output from the subtractor DF3, to thus output a third subtraction signal.

In other words, referring to FIG. 2, the automatic directivity controlling hearing aid according to the present invention, has a multi-stage structure having a first input unit and at least one second input unit IN21, IN22, or IN23. The first input unit IN1 includes a microphone M1, an A/D converter AD1, and an amplifier G1, and amplifies the sound detected in the microphone M1, to thereby output a first input signal. Meanwhile, the second input units IN21, IN22, and IN23 respectively include microphones M2, M3, and M4, A/D converters AD2, AD3, and AD4, amplifiers G2, G3, and G4, and time delays D2, D3, and D4, and amplify the sounds detected in the corresponding microphones M2, M3, and M4, and then delay the amplified results, to thereby output second input signals, respectively. In addition, the three subtractors DF2 to DF4 are configured as a multi-stage. The first stage subtractor DF2 receives the first input signal and the second input signal output from the corresponding second input unit IN21 among the three second input units IN21, IN22, and IN23, and subtracts the second input signal from the first input signal, to thereby output the first subtraction signal. The remaining subtractors DF3 and DF4 subtract the second input signals output from the corresponding second input units IN22 and IN23 from the first and second subtraction signals output from the preceding stage subtractors DF2 and DF3. That is, since the three subtractors DF2 to DF4 are configured as a multi-stage, the corresponding second input signal is cumulatively subtracted from the subtraction signal applied from the preceding stage, to thus output a cumulative subtraction signal.

Here, the reason why the sound signals from the microphones M1 to M4 corresponding to the first input unit IN1 and the second input units IN21, IN22, and IN23 are amplified and delayed is to control direction of directivity of a hearing aid. As mentioned above, even sounds generated from the same sound source reach the distributively disposed microphones M1 to M4 at different times and with different intensities, respectively. Accordingly, the automatic directivity controlling hearing aid according to the present invention controls the amplification factor and the delay time of the sound signal depending on the amplification control signals gs1 to gs4 and the delay time control signals ts2 to ts4 output from the directivity controller SDC, to thereby maximize the sound. In addition, in the hearing aid of FIG. 2 unlike the hearing aid of FIG. 1, the reason why the subtractors DF2 to DF4 are used instead of the adder ADD, to thereby subtract the first and second input signals from each other, is because the intensity of the sound becomes larger when the difference between the signals is generated by using the subtractors DF2 to DF4, in contrast to the case of using the adders in order to add the signals that are applied to the adder.

A first buffer B1 buffers the cumulative subtraction signal output from the final subtractor DF4 and then outputs the buffered signal. An output amplifier GF receives the output signal from the first buffer B1 and amplifies the received signal by a predetermined amplification factor to then be output to a second buffer B2. The second buffer B2 amplifies the signal output from the output amplifier GF and outputs the amplified result to the D/A converter DA. The D/A converter DA converts the signal output from the second buffer B2 into an analog signal and outputs the analog signal to the receiver RV. The receiver RV includes an acoustic output device such as a speaker and outputs the analog signal output from the D/A converter DA as the sound that can be heard by users.

In FIG. 2, the first input unit IN1, the second input units IN21, IN22, and IN23, the subtractors DF2 to DF4, and the first buffer B1 are configured into an input unit of the hearing aid 10 that processes detection of the sound, and amplification, delay, and subtraction of the detected sound, depending on the direction of directivity, and the output amplifier GF, the second buffer B2, the D/A converter DA, and the receiver RV are configured into an output unit of the hearing aid 10 that outputs the sound to users. In addition, the output unit further includes a wireless transmitter and a wireless receiver between the second buffer B2 and the D/A converter DA, and between the D/A converter DA and the receiver RV, respectively, so that the receiver receives the signal wirelessly and outputs the sound. In addition, in some cases, the first and second buffers B1 and B2 may be omitted.

The directivity controller SDC receives the buffered signal ds from the first buffer B1, filters the received signal, and extracts a speech sound from the filtered result. In addition, the intensity of the extracted speech sound is determined. In this case, when the intensity of the extracted speech sound is lower than a predetermined threshold value, it is judged that the direction of the directivity of the hearing aid does not match location of the sound source from which the speech was generated, to thereby control the amplification control signals gs1 to gs4 and the delay time control signals ts2 to ts4 and to then output the controlled result. Accordingly, the amplification factor of the amplifier G1 of the first input unit IN1, the amplification factors of the amplifier G2 to G4 of the second input units IN21, IN22, and IN23, and the signal delay times of the time delays D2 to D4, automatically change the direction of the directivity of the hearing aid. The directivity controller SDC continues to change the direction of the directivity of the hearing aid, until the intensity of the extracted speech sound becomes more than the threshold value of the hearing aid. In addition, when the intensity of the extracted speech sound is more than the predetermined threshold value, it is judged that the direction of the directivity of the hearing aid does not match location of the sound source from which the speech was generated, to thereby make values of the amplification control signals gs1 to gs4 and the delay time control signals ts2 to ts4 fixed. Thereafter, when the intensity of the extracted speech sound is again lower than the predetermined threshold value, the amplification control signals gs1 to gs4 and the delay time control signals ts2 to ts4 are controlled to thus automatically change the direction of the directivity of the hearing aid.

Accordingly, the automatic directivity controlling hearing aid according to the present invention, amplifies, delays, and subtracts voices that are input via a plurality of microphones that are distributively disposed in the hearing aid, differently from each other, and then extracts speech sound from the voices, to then automatically control the direction of the directivity of the hearing aid so that the extracted speech sound becomes more than a predetermined threshold value. Thus, since the direction of the directivity of the hearing aids is automatically controlled, the user who uses the hearing aid can hear the speech sound that is always amplified into the intensity more than the threshold value, to thereby make the user recognize other people's voices clearly.

The detailed configuration and operation of the directivity controller SDC will be described later.

Figure 3:
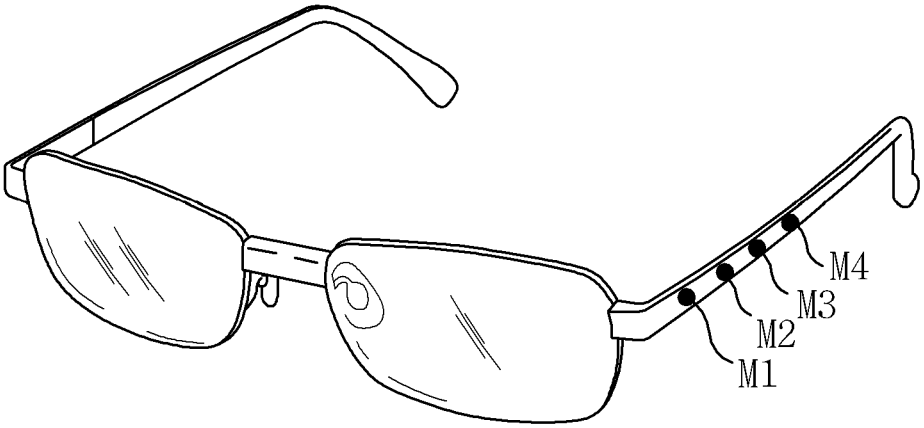
FIG. 3 is a perspective view illustrating an example of placement of microphones automatic directivity controlling hearing aid according to the present invention.

FIG. 3 is a perspective view illustrating an example of placement of microphones in an automatic directivity controlling hearing aid according to the present invention.

As described above, in the case of the automatic; directivity controlling hearing aid according to the present invention, a plurality of microphones M1 to M4 are distributively disposed to easily detect the direction of the directivity of the hearing aid. The plurality of the microphones M1 to M4 are preferably arranged to be spaced apart from each other by a predetermined distance (for example, 5 mm) or above. This is because the times when the voices are input to all the microphones are almost the same regardless of the direction of the sound source so that it is difficult to determine the direction of the sound source, if the multiple microphones are placed close to each other.

According to recent advances in technologies of microphones, the microphones become extremely smaller compared to conventional ones, and thus two or more microphones (for example, four) may be easily disposed even in a tiny ITE (In-The-Ear) type hearing aid. Since it is difficult to recognize the direction of the sound source in the case that a number of microphones (for example, four) are positioned very closely to each other in the tiny hearing aid such as the ITE type hearing aid as described above, only production costs rise up but an effect of detecting the direction of the sound source is insignificant. However, in the case that the hearing aids that are relatively large such as pocket type hearing aids and eyeglass type hearing aids, multiple microphones (for example, four) are distributively disposed over a predetermined interval, to thereby more accurately determine the location of the sound source.

Here, FIG. 3 shows an eyeglass type hearing aid as an example of the hearing aid in which multiple microphones M1 to M4 are distributively disposed. As shown in FIG. 3, in the case of the eyeglass type hearing aid, multiple microphones can be distributively placed at predetermined intervals on the leg of a pair of eyeglasses, and thus it is very easy to detect the direction of the directivity of the hearing aid.

An increase in the number of microphones leads to a rise in the production cost, and even hearing aids that are relatively large such as pocket-type hearing aids, and eyeglass type hearing aids are bound to cause the space constraints. In addition, the hearing aid according to the present invention does not have an object of exactly determining the location where human voices are generated, discriminatively from the ambient sounds, but has an object of enhancing the directivity of the hearing aid toward the location where the human voices have occurred, to thereby make users better hear the human voices. Therefore, it is not necessary to place a large number of the microphones (for example, ten or more).

The microphones are arranges on only one leg of the eyeglasses in the eyeglass type hearing aid in FIG. 3, but it is apparent to place microphones on both legs of the eyeglasses in the eyeglass type hearing aid. In addition, microphones can be arranged in various forms in other hearing aids, depending on the types of the hearing aids.

Figure 4:
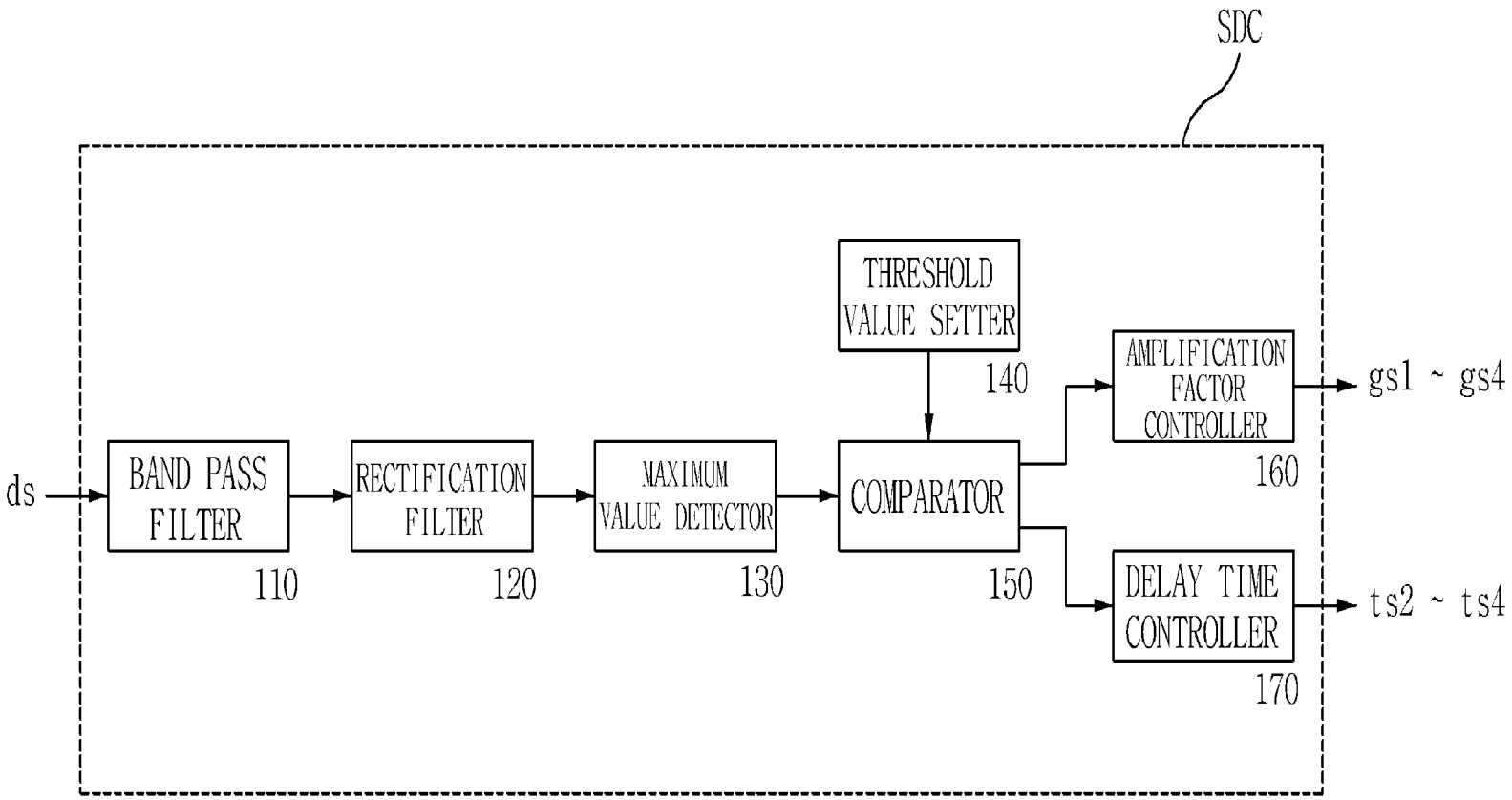
FIG. 4 is a block diagram showing an example of a detailed configuration of a directivity controller of FIG. 2.

FIG. 4 is a block diagram showing an example of a detailed configuration of a directivity controller of FIG. 2.

Referring to FIG. 4, the directivity controller SDC includes a band-pass filter 110, a rectification filter 120, a maximum value detector 130, a threshold value setter 140, a comparator 150, an amplification factor controller 160, and a delay time controller 170.

The band pass filter 110 receives a signal ds output from the first buffer B1, and performs filtering for a band of 100 Hz to 4 KHz with a center frequency of 1 KHz, to thereby extract a speech sound signal of the most important frequency band in a speech sound among voices detected via the microphones M1 to M4. The rectification filter 120 receives the speech sound signal output from the band pass filter 110, and rectifies the received speech sound signal to thus cancel noise contained in the speech sound signal. Here, a full digital rectification filter is preferably used as a rectifier filter 120.

The maximum value detector 130 detects the level of the speech sound signal output from the rectifier filter 120, and obtains the maximum value of the detected level. The threshold value setter 140 stores a threshold value for setting the direction of the directivity of the hearing aid 10. However, users can directly specify the threshold value. The threshold value can be set in various forms depending on the type of the hearing aid, but the threshold value is set to 10 dB as an example in the present invention. The comparator 150 compares the maximum value of the speech sound signal detected from the maximum value detector with the threshold value stored in the threshold value setter 140, to thus output the comparison value to the amplification factor controller 160 and the delay time controller 170.

The amplification factor controller 160 and the delay time controller 170 keep and output the amplification control signals gs1 to gs4 and the delay time control signals ts2 to ts4 as the preceding states if the maximum value is greater than or equal to the threshold value, in response to the comparison value, respectively. However, if the maximum value is less than the threshold value, the direction of directivity does not match the direction of the sound source, and thus the amplification factor controller 160 and the delay time controller 170 change the amplification control signals gs1 to gs4 and the delay time control signals ts2 to ts4 and output the changed results.

In other words, the directivity controller SDC receives the signal ds output from the input unit, and extracts the speech sound signal and detects the level from the received signal ds, to thereby control the amplification control signals gs1 to gs4 and the delay time control signals ts2 to ts4 so that the level of the detected speech sound signal is above the predetermined threshold value.

The input unit amplifies and delays the voice signals applied from the plurality of microphones M1 to M4, differently from each other, to thus automatically control the direction of the directivity of the hearing aid in response to the controlled amplification control signals gs1 to gs4 and the delay time control signals ts2 to ts4. In other words, the direction of the directivity of the hearing aid is automatically controlled, in a manner that the voices that are applied at the respectively different times and with the respectively different intensities based on the locations at which the multiple microphones M1 to M4 are disposed, are controlled at the respectively different times and with the respectively different amplification factors and match each other.

Therefore, the automatic directivity controlling hearing aid 10 according to the present invention, can control the direction of directivity automatically so that the intensity of the speech sound is above the threshold value irrespective of the direction of the sound source. Thus, any voices from any directions can be heard accurately by increasing the intensity of the speech sound against background noise.

The method according to the present invention may be embodied as a computer readable code on a computer readable recording medium. The computer-readable recording medium includes any data storage device in which data readable by a computer system is stored. Examples of the computer readable recording medium are ROMs, RAMs, CD-ROMs, magnetic tapes, floppy disks, optical data storage devices, and so on, and may be also implemented in the form of a carrier wave (for example, transmission through the Internet). The computer readable recording medium is distributed in networked computer systems in which the computer readable codes are stored and executed in a distributed manner.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

The invention claimed is:

1. A hearing aid for automatically controlling directivity, the hearing aid comprising:

a first input unit that senses a sound to thus generate a first audio signal, and amplifies the first audio signal in response to a first amplification control signal, to then output a first input signal;

at least one second input unit that senses the sound to thus generate a second audio signal, and amplifies and delays the second audio signal in response to at least one second amplification control signal and at least one delay time control signal, to then output a second input signal;

a subtraction unit having at least one subtractor that is configured in a multi-stage of the same number as that of the at least one second input unit, and that subtracts the second input signal output from a corresponding second input unit among the at least one second input unit from a cumulative subtraction signal output from a preceding stage, to thus output the cumulative subtraction signal;

a directivity controller that receives the cumulative subtraction signal output from a last stage subtractor among the at least one subtractor, performs a filtering of the received signal to thus extract a speech sound signal, compares the maximum value of the extracted speech sound signal with a predetermined threshold value, and controls the first amplification control signal, the at least one second amplification control signal, and the at least one delay time control signal, to thus output the controlled result; and an output unit that receives and amplifies the cumulative subtraction signal output from the last stage subtractor among the at least one subtractor, wherein the directivity controller comprises:

a filter unit that receives and filters the cumulative subtraction signal, to thereby extracting the speech signal;

a maximum value detector for detecting the level of the speech signal and detecting the maximum value;

a threshold value setting unit that set and stores the threshold;

a comparator that compares the maximum value with the threshold value, and outputs a comparison value if the maximum value is less than the threshold value;

an amplification factor controller that controls the first amplification control signal and the at least one second amplification control signal, respectively, in response to the comparison value, and outputs the controller result; and a delay time controller that controls the at least one delay time control signal, respectively, in response to the comparison value, and outputs the controller result, wherein the filter unit comprises:

a band-pass filter that receives the cumulative signal and performs band pass filtering; and a rectifier filter that rectifies the output signal of the band-pass filter, and outputs the speech sound signal.

2. The hearing aid according to claim 1, wherein the band-pass filter extracts a band signal of 100 Hz to 4 KHz with a center frequency of 1 KHz.

3. The hearing aid according to claim 1, wherein the subtraction unit is configured so that the first stage subtractor among the at least subtractor subtracts the corresponding second input signal among the at least one second input signal from the first input signal, to thereby output the cumulative subtraction signal, and the last stage subtractor subtracts the corresponding second input signal among the at least one second input signal from the cumulative subtraction signal output from the preceding stage subtractor, to thereby output the cumulative subtraction signal.

4. The hearing aid according to claim 1, wherein the first input unit comprises:

a first microphone that senses the sound and thus generates the first sound signal that is an analog signal;

a first analog-to-digital (A/D) converter that converts the first sound signal into a digital signal; and a first amplifier that amplifies the output signal of the first analog-to-digital (A/D) converter and outputs the amplification result, in response to the first amplification control signal output from the directivity controller.

5. The hearing aid according to claim 4, wherein the at least one second input unit comprises:

a second microphone that senses the sound and thus generates the second sound signal that is an analog signal;

a second analog-to-digital (A/D) converter that converts the second sound signal into a digital signal;

a second amplifier that amplifies the output signal of the second analog-to-digital (A/D) converter and outputs the amplification result, in response to the second amplification control signal among the at least one amplification control signal output from the directivity controller; and a second time delay that delays the output signal of the second amplifier and outputs the delay result, in response to the delay time control signal among the at least one delay time signal output from the directivity controller.

6. The hearing aid according to claim 1, wherein the output unit comprises:

an output amplifier that receives the cumulative subtraction signal output from the subtractor, and amplifies the received signal to then output the amplified result;

a digital-to-analog (D/A) converter that converts the output signal of the output amplifier into an analog signal; and a receiver having a speaker, and that receives the output signal of the D/A converter and outputs the received signal as the sound.

7. The hearing aid according to claim 6, further comprising:

a first buffer that receives and buffers the cumulative subtraction signal output from the subtraction unit, to then output the buffered result to the output amplifier; and a second buffer that receives and buffers the signal output from the output amplifier, to then output the buffered result to the digital-to-analog (D/A) converter.

* * * * *